United States Patent [19]

Troncoso, Jr.

[11] Patent Number: 4,827,895

[45] Date of Patent: May 9, 1989

[54] ARCHERY BOX ARROW REST

[76] Inventor: Fernando Troncoso, Jr., 14090-6100 Rd., Montrose, Colo. 81401

[21] Appl. No.: 185,418

[22] Filed: Apr. 25, 1988

[51] Int. Cl.[4] ..... F41B 5/00

[52] U.S. Cl. ..... 124/41 A; 124/24 R

[58] Field of Search ..... 124/24 R, 41 A, 86, 124/88

[56] References Cited

U.S. PATENT DOCUMENTS

| | | | |
|---|---|---|---|
| 3,372,686 | 3/1968 | Losh | 124/41 A |
| 3,828,757 | 8/1974 | Finlay | 124/41 A |
| 3,865,096 | 2/1975 | Troncoso | 124/24 R |
| 3,871,352 | 3/1975 | Stanislawski et al. | 124/41 A |
| 3,935,854 | 2/1976 | Troncoso | 124/24 R |
| 4,236,497 | 12/1980 | Troncoso | 124/24 R |
| 4,332,232 | 6/1982 | Troncoso | 124/24 R |
| 4,664,093 | 5/1987 | Nunemaker | 124/24 R |
| 4,686,956 | 8/1987 | Troncoso | 124/41 A |
| 4,748,964 | 6/1988 | Troncoso | 124/41 A |

*Primary Examiner*—Randolph A. Reese
*Assistant Examiner*—John A. Ricci
*Attorney, Agent, or Firm*—Donald E. Nist

[57] ABSTRACT

The archery bow arrow rest may include an elongated mounting block, the front portion of which is adapted to be connected to the sidewall of an archery bow with the remainder of the block extending rearwardly to a point behind the bow window. A transverse bar may be rotatingly connected to the block behind the window and bears a pair of resilient, upwardly and forwardly extending arrow-supporting blades. The second blade is weaker, longer and wider than the first and is mounted immediately below the first blade, extends forwardly thereof and rises thereabove. The front end of the second blade bent is up and is forked or notched with a pair of spaced diverging or parallel lines adapted to bracket an arrow shaft without gripping it so as to prevent arrow roll-off from the rest. The first blade's front end is also forked or notched to hold the underside of the arrow shaft. When an arrow shaft is supported by the two blades, they contact the shaft at two spaced points along the length of the shaft for better support. The second blade is weak enough to be easily flicked down and out of the way when the vanes of an arrow just shot by the bow strike it, without damaging the vanes or interfering with arrow flight. The blades may be biased into the arrow-supporting position by a spring connected to the bar and block and thus are vertically depressable. Rotational limit components, as well as bar position-adjusting components may also be provided.

14 Claims, 1 Drawing Sheet

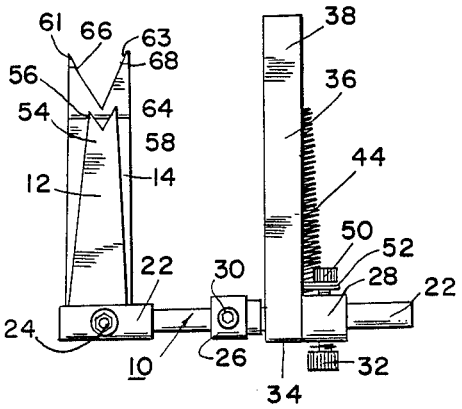
FIG. 1
FIG. 2
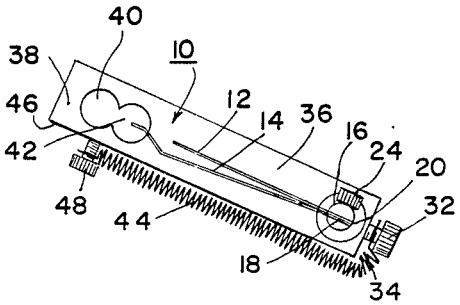
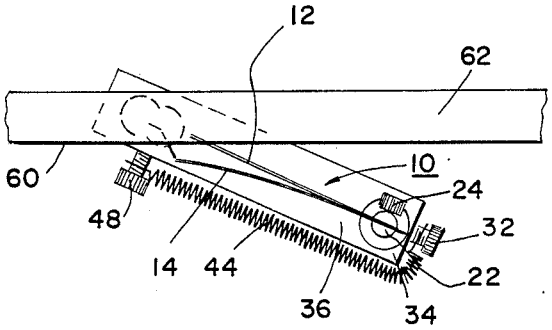
FIG. 3
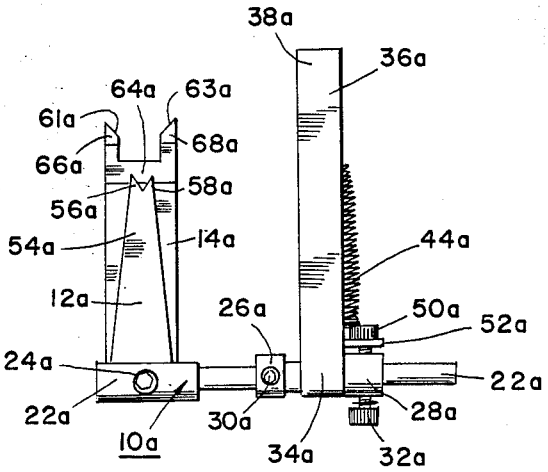
FIG. 4
FIG. 5
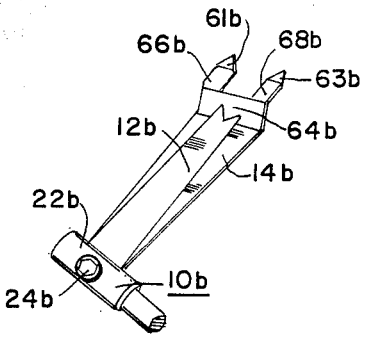

ARCHERY BOX ARROW REST

BACKGROUND OF THE INVENTION

1. Field of the Invention

The present invention generally relates to archery equipment and more particularly to an arrow rest of an improved type.

2. Prior Art

Most launcher types of arrow rests comprise free-standing blades upon the upper end of which the arrow shaft is balanced for shooting. Many of such blades are not used in combination with a side plate or side cushion plunger. This is because they are usually used with mechanical release aids which produce less archer's paradox and little need for side pressure point devices to dampen arrow shaft side oscillations. However, with the described devices, there is a major problem of inadvertant arrow roll-off. Not enough side support for the arrow is provided by the rest to enable the bow to be carried with the arrow in place, ready to shoot, without serious danger of rolling off the rest.

The arrow rest disclosed in U.S. Pat. No. 4,686,956 solves the foregoing problems. Thus, a rest is shown in that patent which is of the arrow launcher notched blade type but which is flanked by a pair of upwardly extending,curved,mantis-like side wires which flank the blade and which grip opposite sides of the arrow shaft when it is on the rest blade, in order to hold it in place. Unfortunately, the wires must be bent precisely to accommodate arrow shafts of different diameters and to accommodate the configuration and shape of various types of arrow vanes or fletching, without interference with the vanes or fletching during arrow flight. Failure to bend the wires properly results in vane or fletching striking the wires, throwing the arrow off its proper path and severely and rapidly wearing the vanes or fletching.

Accordingly, there is a need for an improved arrow rest which will prevent arrow roll off from the rest, thus enabling the bow to be carried with the arrow strung thereon and ready to be shot, a particular aid for bowhunting purposes, when game may suddenly appear at any time and the opportunity to shoot it is of very limited duration such a rest should also provide improved unimpeded, smooth arrow flight and greater arrow speed with a resulting flatter arrow trajectory and greater accuracy, all without feather or vane interference and wear. Moreover, such rest should be capable of use without needing bending or other adjustment of its components.

SUMMARY OF THE INVENTION

The foregoing needs are all satisfied by the improved rest of the present invention. The rest is substantially as set forth in the Abstract of the Disclosure. Thus, it may include an elongated mounting block with a rear, adjustable transverse bar rotatingly mounted therein and bearing a pair of resilient upwardly and forwardly extending arrow-supporting blades in stacked relation, one above the other.

The shorter, narrow and stiffer of the two blades is uppermost and is used as the launcher blade. It bears a small forked or notched front end with small spaced tines adapted to support the underside of the arrow shaft. It is sufficiently narrow to avoid interference with the arrow vanes as fletching and arrow flight.

The longer, wider more flexible and resilient second blade positioned directly below the first blade is used as the anti-roll off blade. It bears a larger forked or notched front end protruding ahead of and above the first blade, with spaced tines adapted to cradle the arrow shaft without necessarily gripping the sides thereof. The second blade is adapted to very easily flick down out of the arrow path when struck by the arrow vanes or fletching, without interfering with the vanes or fleching and arrow flight.

Preferably, the mounting bar for the blades is secured to the rear end of the blades and is rotatingly mounted to the block. A spring may be connected to the block and bar to bias the blades into an arrow-supporting position, but permitting blade depressability against the spring bias. Limit means can be provided to control the arc of rotation of the bar, and the bar may be transversely adjustable relative to the mounting block.

Other means for supporting and mounting the arrow rest blades can be used in place of the block, etc. Thus, the bar can be mounted directly in the bow sidewall adjacent to the rear end thereof. Other arrangements are also possible. Further features of the present invention are set forth in the following detailed description and accompanying drawings.

DRAWINGS

FIG. 1 is a schematic top plan view of a first preferred embodiment of the improved archery bow arrow rest of the present invention;

FIG. 2 is a schematic side elevation of the rest of FIG. 1 without an arrow present on the rest;

FIG. 3 is a schematic side elevation of the rest of FIG. 1 with an arrow shaft on the rest;

FIG. 4 is a schematic top plan view of a second preferred embodiment of the improved arrow rest of the present invention; and, FIG. 5 is a schematic fragmentary side perspective view of the blade and bar portion of a third preferred embodiment of the improved arrow rest of the present invention.

DETAILED DESCRIPTION

FIGS. 1–3

A first preferred embodiment of the improved archery bow arrow rest of the present invention is schematically depicted in FIGS. 1–3. Thus, rest 10 is shown which comprises a pair of flexible resilient blades 12 and 14. Blade 12 is narrower, shorter and stiffer than blade 14 and is positioned directly above blade 14. However, both of blades 12 and 14 are flexible and resilient. They extend upwardly and forwardly and are adapted to project forwardly into the arrow window of an archery bow (not shown).

The rear ends 16 and 18, respectively of blades 12 and 14 are secured in a slot 20 in a transverse metal or plastic support bar 22 by a set screw 24. Bar 22 bears a spaced pair of collars 26 and 28 releasably secured thereto by set screws 30 and 32, respectively, which collars 26 and 28 bracket the rear end 34 of a rearwardly extending metal or plastic mounting block 36 through which bar 22 passes at a rigid angle. Collars 26 and 28 allow the lateral spacing between blades 12 and 14 on the one hand and block 36 to be adjusted as desired. The front end 38 of block 36 defines a pair of overlapping mounting holes 40 and 42 passing transversely therethrough, through which mounting bolts or the like (not shown)

may be secured. Front end 38 of block 36 is adapted to be mounted to the sidewall of an archery bow in the area defining the side of the bow's arrow window (not shown), with rear 34 of block 36 extending behind the bow window.

Bar 22 also extends behind the bow window, with blades 12 and 14 extending forwardly into such window.

Bar 22 is rotatably mounted to block and is springbiased, due to a spring 44 connected to the underside 46 of block 36 by a screw 48 and also connected to bar 22 by screw 32. Spring 44 biases 12 and 14 into the arrow supporting position shown in FIGS. 1–3. Upward rotation of blades 12 and 14 is limited by a screw 50 in collar 28 bridged by an overlying stud 52 connected to block 36. Thus blades are resiliently depressable due both to their own flexibility and to the described spring bias.

The narrow front end 54 of blade 12 is forked or notched, providing a pair of diverging tines 56 and 58 adapted to support the underside 60 of an arrow shaft 62 (FIG. 3). Blade 12 is sufficiently small and narrow to avoid interference with shaft 62 and with the vanes or fletching (not shown) carried by shaft 62, so as to avoid damage thereto and poor arrow flight. Blade 12 may be spring steel, plastic or the like.

Blade 14 is broader, longer and more flexible than blade 12 and is usually made of thin resilient plastic, rubber or the like. The front end 64 of blade 14 is ahead of end 54 of blade 12 is notched or forked to provide a pair of diverging tines 66 and 68 spaced sufficiently far apart so as to bracket the opposite sides of shaft 60 (FIG. 3), preferably without gripping those sides. Tines 66 and 68 effectively prevent rolling off of shaft 60 from rest 10 even when an archery bow bearing rest 10 is tilted as when it is being carried with arrow 62 strung thereon. End 64 is bent up so as to rise above end 54, with the tips 61 and 63 of tines 66 and 68, respectively bent forward.

It should be noted that when shaft 60 is positioned on blade 12 (FIG. 3), blade 14 is bent down by the weight of shaft 60 and brackets shaft 60 forward of the point of contact of blade 12 and shaft 60, thus providing a spaced two point contact array for improved support of arrow 62 on rest 10. When arrow 62 is shot from a bow bearing rest 10, blade 14 is sufficiently weak so that when it is struck vanes the vanes or fletching of arrow 60, it is flicked down out of the path thereof without damaging the vanes or fletching without interfering with the flight of arrow 62.

Accordingly, rest 10 is novel in construction and has a number of advantages over conventional arrow rests.

FIG. 4

A second preferred embodiment of the improved arrow rest of the present invention is schematically depicted in FIG. 4. Thus, rest **10*a* is identical to rest 10, except that tines 66*a* and 68*a* are parallel,not diverging, and the space there between is generally rectangular for better holding of shaft 60 in a loose non-gripping manner. Moreover, the inner surfaces of tips 61*a* and 63*a* are sloped so that tips 61*a* and 63*a*** are pointed.

FIG. 5

A third preferred embodiment of the improved arrow rest of the present invention is schematically depicted in FIG. 5. Thus, rest **10*b* is shown, specifically the blade and bar portion thereof. Components thereof similar to those of rest 10 or 10*a*** bear the same numerals but are succeeded by the letter "b".

Rest **10*b* is identical to rest 10, except for the configuration of front end 64*b* of blade 14*b*. In this regard, tines 66*b* and 68*b* are bent forward along their length, with another flight bend at tips 61b and 63*b***.

It will be understood that, if desired, bar **22*b* could be directly connected to that portion of the sidewall of an archery bow which defines the side of an arrow window, or without rotatable mounting and spring biasing of bar 22 to such sidewall. Preferably, the mounting arrangement described for rests 10 and 10*a*** is employed, however, with comparable advantages and results.

Various other modifications, changes, alterations and additions can be made in the improved arrow rest of the present invention, its components and parameters. All such changes, modifications, alterations and additions as are within the scope of the appended claims form part of the present invention.

What is claimed is:

1. An improved archery bow arrow rest, said rest comprising in combination:

(a) an upwardly and forwardly extending flexible resilient first arrow launcher blade;

(b) a second upwardly and forwardly extending blade adapted to cradle an arrow to prevent roll-off of said arrow from said rest, while said arrow is on said first blade, said second blade being of greater flexibility and resiliency than said first blade,being mounted adjacent to but directly below said first blade, being of greater length than said first blade so as to extend upwardly and forwardly thereof; and, (c) support means holding the rear ends of said first and second blades and adapted for connection of said rest in an archery bow window.

2. The improved archery bow rest of claim 1 wherein said support means includes a rearwardly extending block adapted to be mounted against that portion of an archery bow sidewall which defines an arrow window, and to extend rearwardly of said window, the rear end of said block receiving a transverse bar for rotation relative to said block, said support means including spring means connected to said bar and block biasing said blades into an arrow-supporting position, but permitting depression and rotation of said blades with said bar, and means limiting the rotation of said bar and controlling the lateral adjustability of said bar relative to said block.

3. The improved arrow rest of claim 2 wherein said first blade is spring metal and is narrower and shorter than said second blade and wherein said second blade is plastic.

4. The improved arrow rest of claim 1 wherein said first blade bears a forked front end.

5. The improved arrow rest of claim 4 wherein said forked front end of said first blade bears a pair of diverging tines adapted to contact the underside of an arrow shaft to support said shaft.

6. The improved arrow rest of claim 1 wherein said second blade bears a forked front end.

7. The improved arrow rest of claim 6 wherein said forked front end of said second blade bears a pair of diverging tines adapted to be spaced on opposite sides of an arrow shaft to prevent arrow roll-off.

8. The improved arrow rest of claim 6 wherein the front end of said second blade is bent upwardly so that it rises above the front end of said first blade.

9. The improved arrow rest of claim 8 wherein said tines of said second blade are bent forward.

10. The improved arrow rest of claim 9 wherein the tips of said tines of said second blade are pointed.

11. The improved arrow rest of claim 1 wherein said second blade is sufficiently longer than said first blade so that when an arrow shaft is on said rest said two blades support said arrow at two spaced points along the length of said blade.

12. The improved arrow rest of claim 11 wherein said second blade is sufficiently more resilient than said first blade so as to be displaced by arrow vanes during shooting of an arrow from an archery bow and wherein said first blade is sufficiently narrow so as to also avoid interference and damage to said vanes.

13. The improved arrow rest of claim 1 wherein the front end of said second blade is generally "U" shaped and bears a spaced pair of parallel tines.

14. The improved arrow rest of claim 13 wherein the spacing between said tines is sufficiently wide so that the tines loosely cradle an arrow shaft without gripping said shaft.

* * * * *